United States Patent [19]

Bergdahl, Jr.

[11] Patent Number: 4,527,361

[45] Date of Patent: Jul. 9, 1985

[54] SHARPENER FOR TURNING TOOLS

[76] Inventor: Herbert O. Bergdahl, Jr., R.F.D., Falls Village, Conn. 06031

[21] Appl. No.: 446,348

[22] Filed: Dec. 2, 1982

[51] Int. Cl.[3] ..... B24B 41/06

[52] U.S. Cl. ..... 51/239; 76/82

[58] Field of Search ..... 51/218 A, 238 R, 241 G, 51/217 A, 218 R, 219 R, 220, 224, 239, 216 R, 216 A; 269/71, 59; 76/82

[56] References Cited

U.S. PATENT DOCUMENTS 354,627 12/1886 Dickson ..... 51/218 R
1,013,760 1/1912 Gardner ..... 51/240 A
2,448,309 8/1948 Grieco ..... 51/220
4,091,574 5/1978 Horwitz ..... 51/218 A

*Primary Examiner*—Frederick R. Schmidt
*Assistant Examiner*—Robert A. Rose

[57] ABSTRACT

The sharpening of tools having a handle and a blade with a cutting edge is accomplished by accurately supporting the tool with its cutting edge juxtapositioned to a rotary grinding wheel. The support has an angularly adjustable blade support platform and, spacially displaced therefrom, a handle support which is independently angularly adjustable relative to the blade support platform. The handle support can also be spaced at various distances from the blade support platform.

11 Claims, 10 Drawing Figures

SHARPENER FOR TURNING TOOLS

BACKGROUND OF THE INVENTION (1) Field of the Invention

The present invention relates to the repair of tools and particularly to the sharpening of turning tools. Specifically, the present invention is directed to a device for supporting the blade of a tool at a predetermined angle for sharpening. Accordingly, the general objects of the present invention are to provide novel and improved methods and apparatus of such character.

(2) Description of the Prior Art

Various wood working tools, such as chisels and gouges, must be repeatedly sharpened. These tools are typically sharpened on a grinding machine. Since these tools have an angled cutting edge which varies from tool to tool, the tool must be supported during sharpening such that the cutting edge is applied to the grinding wheel at the appropriate angle.

A previous technique for the sharpening of chisels and gouges involved locking the tool within a vise and then subjecting the cutting edge to grinding. Before being locked within the vise the tool had to be arranged at the appropriate angle. This required painstaking effort which was subject to error. Furthermore, this procedure could not be used to sharpen tools having a curved cutting edge since it is essential that such curved edge tools be rotated during grinding.

There are prior art devices which claim to accomplish the repeated sharpening of the cutting edge of a tool at a preselected angle. An example of such a prior device is disclosed in U.S. Pat. No. 3,848,865. The device of this patent is provided with a support platform which is pivotedly mounted to a transverse extension of a base. This platform can be angularly positioned and retained at a number of predetermined angles. The tool to be sharpened is positioned on and locked to the support platform. While this type of device allows for the repeated sharpening of a straight edged tool, it cannot be employed for the sharpening of a curved edge.

SUMMARY OF THE INVENTION

The present invention overcomes the above-identified disadvantages and other deficiencies of the prior art by providing a device which allows the repeated sharpening of both curved and straight cutting edges at preselected angles.

A sharpening device in accordance with the present invention includes an angularly adjustable support table and a movable carriage assembly. The blade of the tool rests upon the angularly adjustable support table during sharpening by a conventional grinder. The angle of this table is adjusted as necessary to sharpen each specific tool and the angle can be repeatedly obtained. The handle of the tool is positioned on the movable carriage assembly during the sharpening.

The carriage assembly is vertically, i.e., angularly, adjustable with respect to the support table and may be locked in a desired angular orientation relative to the table. The carriage assembly may also be moved toward and away from the support table to accommodate tools of different overall length. The handle of the tool to be sharpened is positioned within a guide groove on the carriage assembly, but is not locked into position. This allows the tool to be rotated about its axis by a worker while a curved cutting edge is being applied against a grinder. A tool with a straight cutting edge can also be sharpened through the use of the present invention by merely holding the tool still.

Accordingly, the general object of the present invention is to provide a tool sharpening device which allows the sharpening of tools which have either straight or curved cutting edges.

BRIEF DESCRIPTION OF THE INVENTION

The present invention may be better understood and its numerous objects and advantages will become apparent to those skilled in the art by reference to the accompanying drawing wherein like reference numerals refer to like elements in the several FIGURES and in which.

Figure 1:
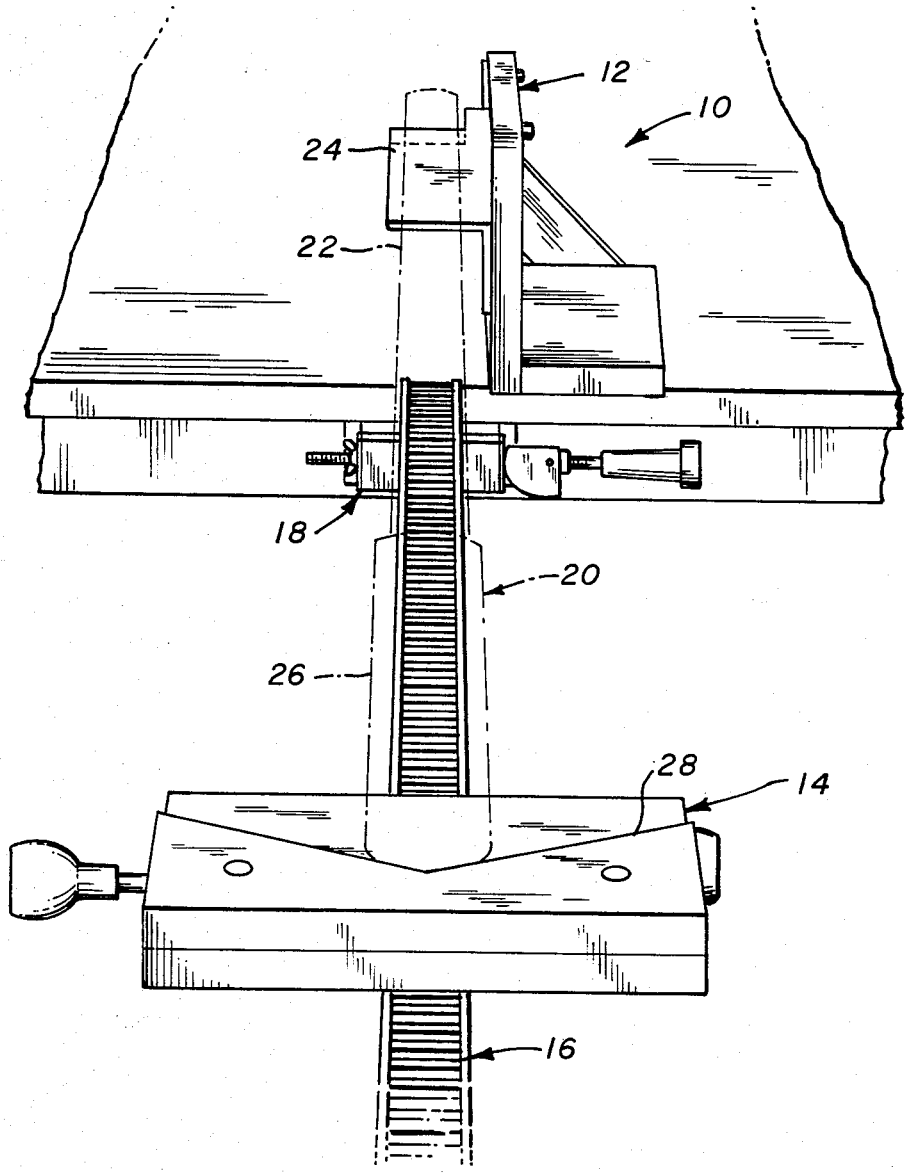
FIG. 1 is a perspective view of the tool sharpening device according to one embodiment of the present invention.
Figure 2A:
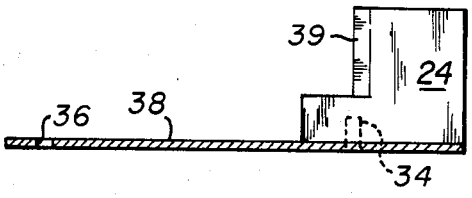
FIG. 2 is a perspective view of the support table of the embodiment of FIG. 1.
Figure 2:
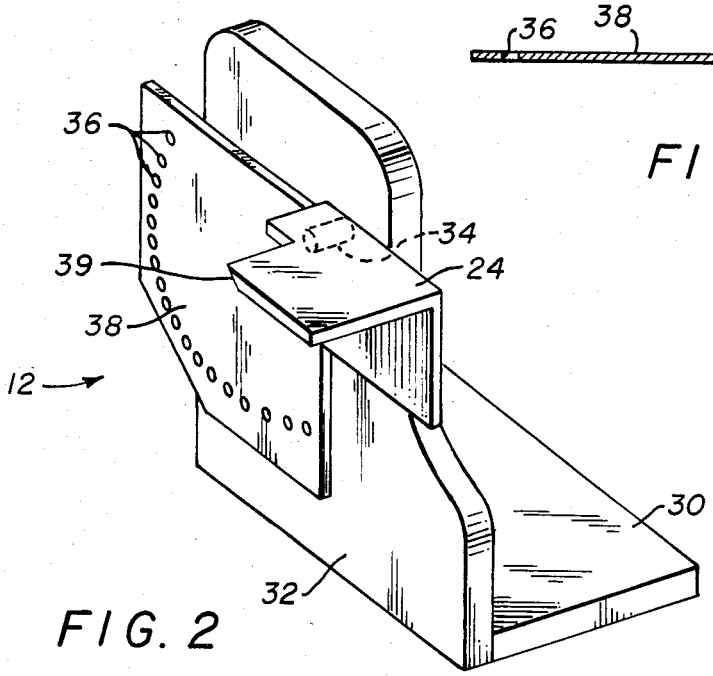
Figure 4:
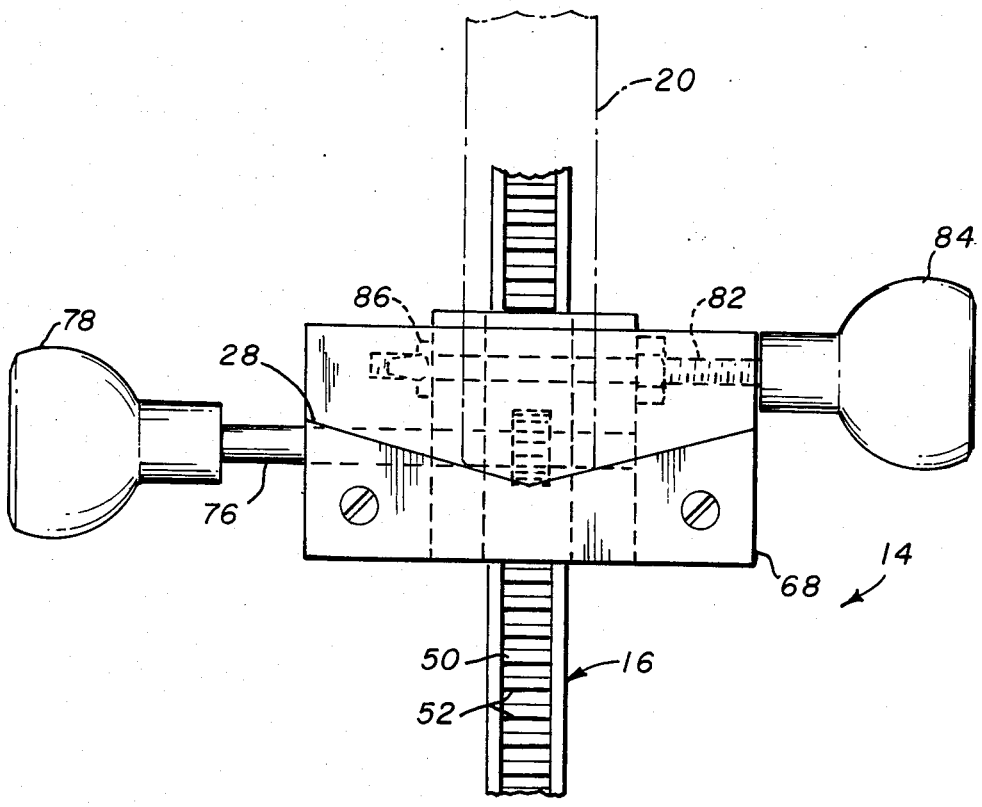
Figure 5:
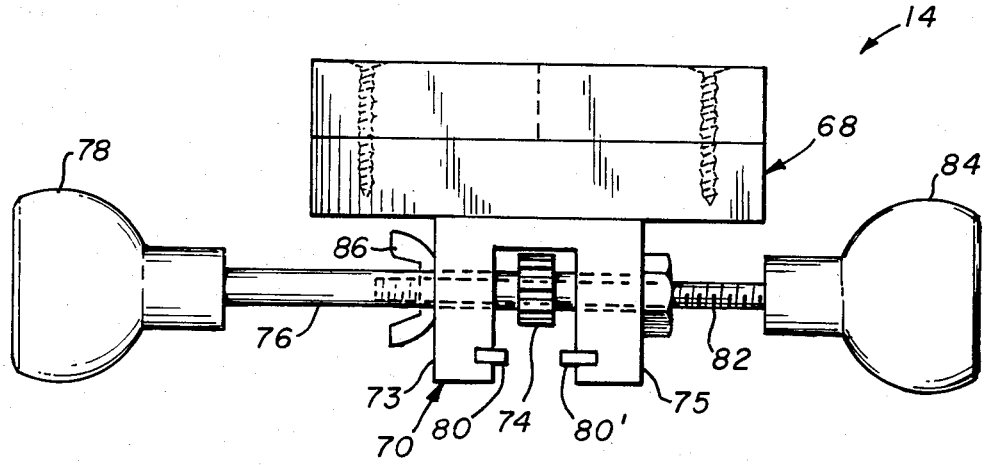

FIG. 2*a* is a bottom view of a portion of the support table of FIG. 2;

FIGS. 3*a* through 3*d* are side views of a cam locking clamp of the embodiment of FIG. 1;

FIG. 4 is a top view of the carriage assembly of the embodiment of FIG. 1;

FIG. 5 is a front view of the carriage assembly of FIG. 4; and

Figure 6:
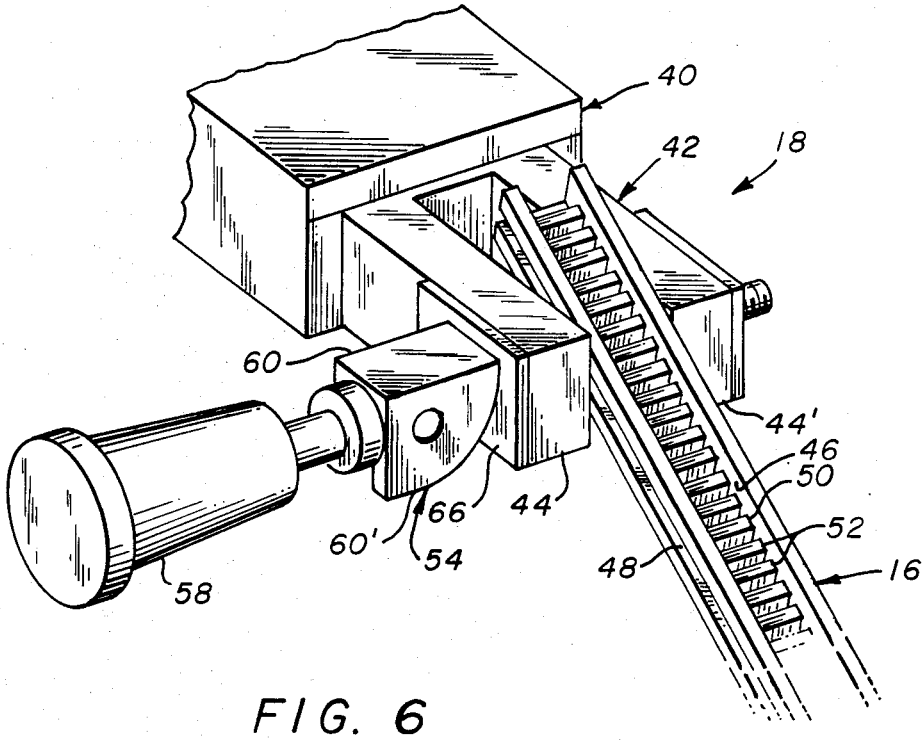
Figure 3A:
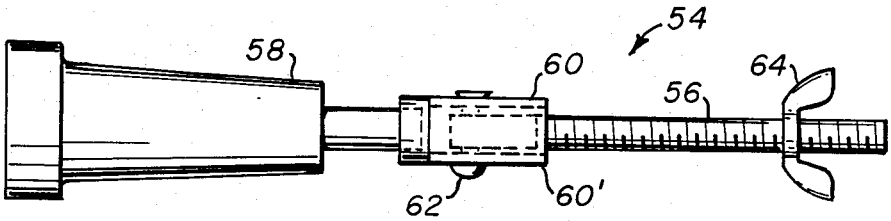
Figure 3B:
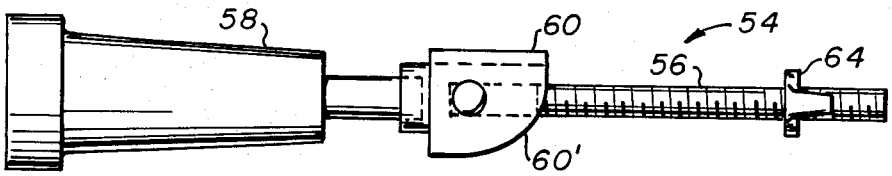
Figure 3C:
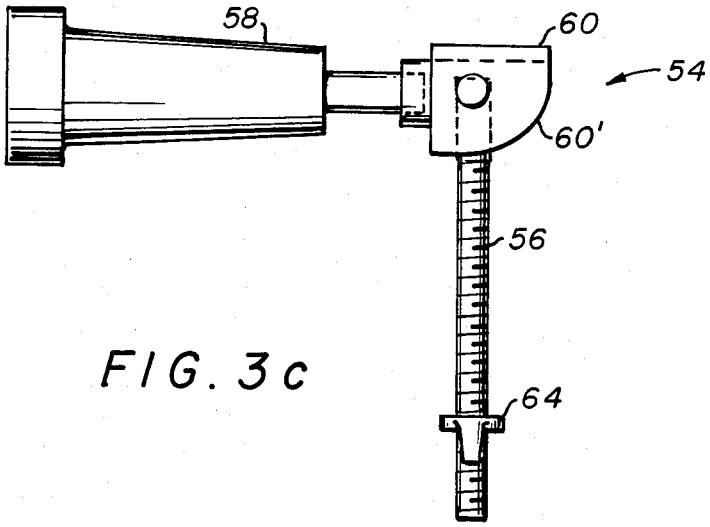
Figure 3D:
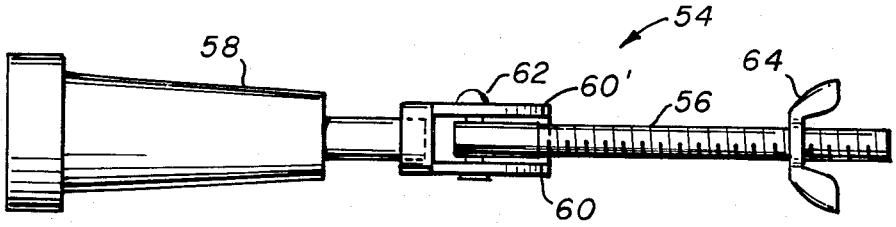

FIG. 6 is an enlarged perspective view of the mechanism which allows angular adjustment of the carriage assembly of the embodiment of FIG. 1.

DESCRIPTION OF THE PREFERRED EMBODIMENT

The present invention is directed to a device which allows the repeated specific angular sharpening of cutting tools, including wood working tools characterized by a curved cutting edge. It should be noted that the present invention will be used with a grinding machine of the type having a grinding wheel which rotates about a horizontal axis. Since such grinding wheels are well known they are not shown in the drawing and will not be further discussed, except as necessary to more fully explain the present invention.

Referring to FIG. 1 a tool holder in accordance with one embodiment of the present invention is indicated generally at 10. Holder 10 includes an angularly adjustable tool blade support, indicated generally at 12, and a relatively movable tool handle support assembly, indicated generally at 14. Handle support assembly 14 comprises a carriage which is adjustably positionable relative to support table 12 by means of movement along a rack 16. The rack 16 is pivotally supported, adjacent a first end thereof, within a fork assembly which has been indicated generally at 18.

The blade support 12 and rack 16 are independently angularly adjustable relative to a horizontal plane in which the axis of rotation of the grinding wheel lies. These angular adjustments, along with the proper spacial positioning of assembly 14 on rack 16, permits a tool indicated generally at 20, and shown in phantom, to be sharpened at the correct angle for its particular cutting edge. The blade 22 of the tool to be sharpened is placed in supporting contact with an angularly adjustable platform member 24 of support 12 while the tool handle 26 is located within a V-shaped guide groove 28 on support assembly 14. The front edge of the blade 22 will engage the rotating grinding wheel and, during sharpening, the handle 26 will be held in place in groove 28 by the application of downward force. If the cutting edge of blade 22 is curved, the handle 26 can be slowly rotated within the V-shaped groove 28 while contact is maintained between the tool handle and bottom of the groove. Thus, either a straight or curved edged cutting blade can be properly and accurately sharpened through use of the present invention.

With reference to FIGS. 2 and 2*a*, the blade support 12 will now be discussed in greater detail. Support 12 is comprised of a first generally L-shaped member having a base portion 30 and a plate 32 which extends therefrom. The platform member 24, which is also generally L-shaped, is secured to plate 32 by a bolt 34 and is angularly adjustable by rotation about the axis of bolt 34. Platform 34 is formed from metal and includes an apertured mounting plate 38 which is oriented parallel to and in abutting relationship to plate 32. The apertures 36 in plate 38 are typically threaded and are arranged in an arcuate pattern so as to allow the positioning of platform 24 at various angles. The preferred spacing between adjacent apertures allows changing the angular orientation of the platform in incremental steps of 7.5°. The platform 24 is retained in the desired angular position by a bolt, not shown, which extends through a threaded hole in plate 32 and engages the appropriate aperture 36. The front lower edge 39 of platform 24 is beveled to provide clearance and thereby permit close spacing between a grinding wheel and the leading edge of the blade support. The bolt 34 must be located at the same height or slightly higher than the center of the grinding wheel arbor. Also, the axis of bolt 34 must lie in the plane defined by beveled surface 39.

Referring jointly to FIGS. 3 and 6, the fork assembly 18 and rack 16 will now be discussed in greater detail. Fork assembly 18 comprises a generally rectangularly shaped body, indicated generally at 40, which receives the stem portion of a double pronged fork member, indicated generally at 42. A first end of rack 16 is positioned between the prongs 44 and 44' of member 42. Rack 16 includes, in the disclosed embodiment, a support which defines a longitudinal trough. This support includes side rails 46 which are provided with parallel slots 48 in their outwardly facing sides. The actual rack member 50, which includes the gear teeth 52, is positioned between the rails 46 as shown and could, of course, extend about rails 46.

Rack 16 is retained between prongs 44 and 44' of fork assembly 18 by a cam-type locking mechanism which is indicated generally at 54. Locking mechanism 54, as seen in FIGS. 3*a*–3*d*, comprises a threaded rod 56 and a handle 58. Threaded rod 56 extends through aligned holes, not shown, provided in both of prongs 44 and 44' and in the end of rack 16. Threaded rod 56 is attached to handle 58 by a pivot assembly which comprises a pair of parallel cam plates 60 and 60' and a bolt or other suitable fastener 62.

Continuing to discuss FIGS. 3*a*–3*d*, the angular adjustment of rack 16 will now be discussed. Threaded rod 56 is inserted through the aligned holes in prongs 44 and 44' and rack 16 and is retained in position by wing nut 64. With rack 16 placed at the desired angular position, the handle 58 is pivoted so that the larger lobe sections of cam plates 60 and 60' are brought to bear against the side of prong 44 of fork assembly 18. This action reduces the space between prongs 44 and 44' and thus frictionally captures the rack 16 in the desired angular position. If fork assembly 18 is comprised of wood, the prongs 44 and 44' upon which the cam plates 60 and 60' act could be provided with a metallic insert as indicated at 66 in FIG. 6.

The positioning of handle support assembly 14 on rack 16 relative to blade support 12 will now be described with particular reference to FIGS. 4 and 5. Assembly 14 is comprised of a base plate 68 to which the member which defines the guide groove 28 is attached. The base plate 68 may comprise a block of wood to which a second block of wood, having a slot or groove of the desired size and shape, is attached by means of screws as shown. A channel defining member, indicated generally at 70, functions as the housing for a pinion gear and is affixed to the underside of plate 68.

Member 70 may be of two-piece construction and has a pair of legs 73 an 75 which form a channel wide enough to allow the passage of rack 16. A pinion gear 74, affixed to a rotatable shaft 76, is positioned between legs 73 and 75 of member 70. A first end of shaft 76 is provided with handle 78 to allow the rotation of pinion gear 74. The second end of shaft 76 passes through an aperture in leg 75 and is retained in position by any suitable means wich allows shaft rotation.

Engagement between pinion 74 and teeth 52 of rack 16 is insured by a pair of rack support members 80 and 80' which extend toward one another from respective of legs 73 and 75. The members 80, 80' respectively engage the longitudinal slots 48 (see FIG. 6) in rack 16. Preferably, the legs 73 and 75 are slightly deflected toward one another through the action of a threaded shaft 82 which extends through aligned holes provided in legs 73 and 75. Shaft 82, which is provided at one end with handle 84, is engaged by a wing nut 86 and an other suitable fastener which respectively bear against the outside surfaces of legs 73 and 75. The degree of compression of the channel in member 70 is varied by adjusting the spacing between the fasteners on shaft 82.

With rack 16 supported on guide members 80, 80', the pinion gear 74 engages teeth 52. Thus, by rotating pinion gear 74 the carriage assembly 14 is moved away from or towards support table 12. As stated above, the handle 26 of tool 20 rests within the guide groove 28 and held firmly if the edge to be sharpened is straight. If the edge to be sharpened is curved the handle 26 of the tool will be rotated. The handle support 14 may, as described above, be raised or lowered, thereby varying the angle at which the tool blade is ground, by rotating rack 16 in fork assembly 18 and/or by varying the angle of platform member 24.

It is to be understood that the invention is not limited to the illustration described and shown herein, which is deemed to be merely illustrative of the best mode of carrying out the invention, and which is susceptible of modification of form, size, arrangement of parts and details of operation. The invention rather is intended to encompass all such modifications which are within its spirit and scope as defined by the claims.

I claim:

1. Apparatus for supporting a cutting tool during the sharpening thereof, the tool having an elongated handle at a first and thereof and an elongated blade with a cutting edge at the other end thereof extending from the handle, said support apparatus being intended for use in combination with a grinding wheel which rotates about a stationary axis and comprising:

tool blade support means, said blade support means including a base portion which defines a plane, said blade support means further including a blade support platform, said platform intended to be juxtapositioned to a grinding wheel, said platform defining a plane and being rotatable about an axis which is parallel to the axis of rotation of the grinding wheel, said base portion defined plane being transverse to a plane which is transverse to said axes, the blade of a tool to be sharpened being positioned on said blade support platform with the cutting edge thereof extending beyond a first side edge of said platform during sharpening whereby a portion of the blade adjacent to the cutting edge to be sharpened is positively supported from below during sharpening;

tool handle support means, said handle support means defining an open sided tool handle receiving guide groove, the handle of a tool having its blade on said support means platform; resting on said handle support means and being movable along said guide groove during sharpening whereby said guide groove may determine a contour of the tool blade cutting edge;

means for adjusting the spacing between said handle support means and said blade support means; and means for varying the angular orientation of said spacing adjusting means whereby the spacing of said handle support means relative to the plane defined by said blade support means base portion may be adjusted, said angular orientation varying means being spacially displaced from the axis of rotation of said blade support means axis.

2. The apparatus of claim 1 wherein said first side edge of said blade support means platform is beveled.

3. The apparatus of claim 2 wherein said beveled first side edge defines a plane and wherein the axis of rotation of said blade support means platform lies in said plane.

4. The apparatus of claim 1 wherein said blade support means comprises:

a generally L-shaped bracket, said bracket defining said blade support means base portion and a side plate which extends transversely with respect to said base portion;

a generaly L-shaped blade support platform defining member, said platform defining member having a side plate which is rotatably coupled to said bracket side plate, said platform defining member side plate being provided with a plurality of positioning apertures, said positioning apertures being arranged in an arcuate array; and locating pin means, said locating pin means being extendable from said bracket side plate to engage a selected one of said positioning apertures to thereby retain said blade support platform in the desired angularly orientation.

5. The apparatus of claim 4 wherein said beveled first side edge defines a plane and wherein the axis of rotation of said blade support means platform lies in said plane.

6. The apparatus of claim 1 wherein said spacing adjusting means comprises:

elongated rack means;

carriage means, said carriage means being affixed to said tool handle support means, said carriage means including a rotatable gear for engaging said rack means, said carriage means further comprising means for imparting rotation to said gear whereby said carriage means may be driven along said rack means;

means for coupling said carriage means to said rack means to thereby establish a cooperative relationship between said rack means and said carriage means gear; and means for supporting said rack means adjacent a first end thereof so that the movement of said carriage means will be generally toward or away from said blade support means platform.

7. The apparatus of claim 4 wherein said spacing adjusting means comprises:

elongated rack means;

carriage means, said carriage means being affixed to said tool handle support means, said carriage means including a rotatable gear for engaging said rack means, said carriage means further comprising means for imparting rotation to said gear whereby said carriage means may be driven along said rack means;

means for coupling said carriage means to said rack means to thereby establish a cooperative relationship between said rack means and said carriage means gear; and means for supporting said rack means adjacent a first end thereof so that the movement of said carriage means will be generally toward or away from said blade support means platform.

8. The apparatus of claim 5 wherein said spacing adjusting means comprises:

elongated rack means;

carriage means, said carriage means being affixed to said tool handle support means, said carriage means including a rotatable gear for engaging said rack means, said carriage means further comprising means for imparting rotation to said gear whereby said carriage means may be driven along said rack means;

means for coupling said carriage means to said rack means to thereby establish a cooperative relationship between said rack means and said carriage means gear; and means for supporting said rack means adjacent a first end thereof so that the movement of said carriage means will be generally toward or away from said blade support means platform.

9. The apparatus of claim 6 wherein said means for supporting said rack means adjacent a first end defines a pivot connection and wherein said means for varying the angular orientation of said spacing adjusting means comprises:

clamp means, said clamp means cooperating with said means for supporting said rack means first end to selectively permit the rotation thereof about a pivot axis which is parallel to said axis about which said blade support platform may be rotated.

10. The apparatus of claim 7 wherein said means for supporting said rack means adjacent a first end defines a pivot connection and wherein said means for varying the angular orientation of said spacing adjusting means comprises:

clamp means, said clamp means cooperating with said means for supporting said rack means first end to selectively permit the rotation thereof about a pivot axis which is parallel to said axis about which said blade support platform may be rotated.

11. The apparatus of claim 8 wherein said means for supporting a first end of said rack means defines a pivot connection and wherein said means for varying the angular orientation of said spacing adjusting means comprises:

clamp means, said clamp means cooperating with said means for supporting said rack means first end to selectively permit the rotation thereof about a pivot axis which is parallel to said axis about which said blade support platform may be rotated.

* * * * *